US009668536B2

(12) United States Patent
Surace et al.

(10) Patent No.: US 9,668,536 B2
(45) Date of Patent: Jun. 6, 2017

(54) SHOE

(71) Applicant: adidas AG, Herzogenaurach (DE)

(72) Inventors: Anja Surace, Herzogenaurach (DE); Christian Zwinger, Herzogenaurach (DE)

(73) Assignee: adidas AG, Herzogenaurach (DE)

( * ) Notice: Subject to any disclaimer, the term of this patent is extended or adjusted under 35 U.S.C. 154(b) by 0 days.

(21) Appl. No.: 14/873,569

(22) Filed: Oct. 2, 2015

(65) Prior Publication Data

US 2016/0095383 A1 Apr. 7, 2016

(30) Foreign Application Priority Data

Oct. 2, 2014 (DE) ..... 10 2014 220 093

(51) Int. Cl.

| | |
|---|---|
| ***A43B 7/20*** | (2006.01) |
| ***A43B 23/28*** | (2006.01) |
| ***A43B 23/08*** | (2006.01) |
| ***A43B 5/00*** | (2006.01) |
| ***A43B 23/02*** | (2006.01) |
| ***A43B 21/24*** | (2006.01) |
| ***A43B 23/26*** | (2006.01) |

(52) U.S. Cl.

CPC ..... *A43B 7/20* (2013.01); *A43B 5/002* (2013.01); *A43B 21/24* (2013.01); *A43B 23/0245* (2013.01); *A43B 23/088* (2013.01); *A43B 23/26* (2013.01); *A43B 23/28* (2013.01)

(58) Field of Classification Search

CPC .. A43B 7/18; A43B 7/20; A43B 23/02; A43B 23/0245; A43B 23/08; A43B 23/088; A43B 23/26

USPC ..... 36/88, 89, 109, 54, 51, 69

See application file for complete search history.

(56) References Cited

U.S. PATENT DOCUMENTS

| | | | | |
|---|---|---|---|---|
| 793,095 | A * | 6/1905 | Rapp | A43B 23/26 36/54 |
| 808,666 | A * | 1/1906 | Linthicum | A43B 3/02 36/1.5 |
| 2,223,339 | A * | 12/1940 | De Liso | A43C 11/006 36/45 |

(Continued)

FOREIGN PATENT DOCUMENTS

| | | |
|---|---|---|
| CA | 2307284 | 10/2001 |
| CN | 87203210 U | 1/1988 |

(Continued)

OTHER PUBLICATIONS

European Application No. 15186037.6, Extended European Search Report mailed on Mar. 7, 2016, 7 pages.

(Continued)

*Primary Examiner* — Marie Bays

(74) *Attorney, Agent, or Firm* — Kilpatrick Townsend & Stockton LLP

(57) ABSTRACT

Described are shoes with a rigid heel portion, and a collar arranged above the rigid heel portion. The collar includes a first collar portion and a second collar portion, the first collar portion and the second collar portion are configured to partially engage an ankle of a wearer of the shoe on a lateral side, a medial side, and a rear side of the ankle when worn. The first collar portion is more flexible than the rigid heel portion, and the second collar portion is more flexible than the first collar portion.

15 Claims, 12 Drawing Sheets

(56) References Cited

U.S. PATENT DOCUMENTS

| | | | | | |
|---|---|---|---|---|---|
| 2,228,065 | A * | 1/1941 | Sbicca | A43C 11/006 | 36/51 |
| 3,007,262 | A * | 11/1961 | Richards | A43C 11/006 | 36/51 |
| 3,803,731 | A | 4/1974 | Zumbro | | |
| 4,366,634 | A | 1/1983 | Giese et al. | | |
| 4,559,722 | A * | 12/1985 | Norton | A43B 5/06 | 36/105 |
| 4,724,623 | A * | 2/1988 | Silverman | A43B 11/00 | 36/112 |
| 4,856,209 | A | 8/1989 | Kenyon et al. | | |
| 4,947,560 | A * | 8/1990 | Fuerst | A43B 23/08 | 36/114 |
| 5,177,884 | A * | 1/1993 | Rullier | A43B 5/0411 | 36/114 |
| 5,289,646 | A * | 3/1994 | Kiyosawa | A43B 23/26 | 36/54 |
| 5,430,958 | A * | 7/1995 | Kiyosawa | A43B 23/26 | 36/54 |
| 5,533,279 | A * | 7/1996 | Mitsui | A43B 5/00 | 36/45 |
| 5,765,296 | A * | 6/1998 | Ludemann | A43B 23/047 | 36/50.1 |
| 6,079,124 | A * | 6/2000 | Dalvy | A43B 19/00 | 36/10 |
| 6,550,159 | B1 * | 4/2003 | Madore | A43B 7/20 | 280/11.18 |
| 6,564,393 | B2 * | 5/2003 | Davies | A41B 11/00 | 2/239 |
| 6,993,860 | B2 * | 2/2006 | Bettiol | A43B 23/26 | 36/118.6 |
| 7,290,355 | B2 * | 11/2007 | Labonte | A43B 23/26 | 36/54 |
| 7,530,182 | B2 * | 5/2009 | Munns | A43B 3/166 | 36/109 |
| 8,438,757 | B2 * | 5/2013 | Roser | A43C 1/00 | 36/45 |
| 2005/0115111 | A1 * | 6/2005 | Yamashita | A43B 7/20 | 36/89 |
| 2005/0166426 | A1 * | 8/2005 | Donnadieu | A43B 5/0411 | 36/50.5 |
| 2005/0193594 | A1 * | 9/2005 | Murphy | A43B 5/1616 | 36/89 |
| 2005/0229436 | A1 * | 10/2005 | Bock | A43B 5/1691 | 36/115 |
| 2005/0268493 | A1 * | 12/2005 | Foxen | A43B 3/24 | 36/89 |
| 2006/0032090 | A1 * | 2/2006 | Chen | A43B 3/26 | 36/58.5 |
| 2006/0075663 | A1 | 4/2006 | Nakano | | |
| 2012/0233884 | A1 * | 9/2012 | Greene | A43B 1/04 | 36/84 |
| 2013/0047471 | A1 | 2/2013 | Liang | | |

FOREIGN PATENT DOCUMENTS

| | | |
|---|---|---|
| CN | 2590417 | 12/2003 |
| CN | 201995691 | 10/2011 |
| DE | 69002425 | 12/1993 |
| EP | 307379 | 3/1989 |
| FR | 2743474 | 7/1997 |
| FR | 2886107 A1 | 12/2006 |
| GB | 2125272 | 3/1984 |

OTHER PUBLICATIONS

Hill, Canyoning footwear: 5.10 Canyoneer SAR versus the Dunlop Volley, Fat Canyoners, aus: http://web.archive.org/web/20120216035414/http://fatcanyoners.org/bush-guide/5-10-canyoneer-sar/, Feb. 2012.

German Patent Application No. 102014220093.8, Office Action mailed on Aug. 26, 2015, 10 pages.

Ripstop, http://en.wikipedia.org/wiki/Ripstop, available on the internet at least as early as Jun. 27, 2016, 2 pages.

Chinese Application No. 201510644547.X, Office Action mailed Nov. 28, 2016, 7 pages (No English translation available. A summary of the Office Action is provided in the Transmittal Letter submitted herewith).

* cited by examiner

SHOE

CROSS REFERENCE TO RELATED APPLICATION

This application is related to and claims priority benefits from German Patent Application No. DE 10 2014 220 093.8, filed on Oct. 2, 2014, entitled Shoe ("the '093 application"). The '093 application is hereby incorporated herein in its entirety by this reference.

FIELD OF THE INVENTION

The present invention relates to a shoe, in particular a hiking shoe or hiking boot, comprising a collar.

BACKGROUND

Shoes serve various purposes for protecting and safeguarding a wearer's foot. The sole of a shoe typically provides friction and cushions impacts on the foot. For sports, such as hiking, shoes are moreover provided with a rigid heel portion which provides a sufficient stability of the foot within the shoe and specifically protects the heel portion of the foot. Particularly for outdoor applications, shoes are supposed to protect the foot and to keep the foot warm and dry, but at the same time to allow for a certain amount of ventilation to avoid sweat and odor. Therefore, significant efforts in material science have been made to improve the materials used in shoe uppers.

A further objective in the design of outdoor shoes is to provide a sealing of the opening between the shoe and the foot/leg. A shoe upper material which protects the foot and keeps it warm may be of limited use without a proper sealing between the shoe upper and the foot. Otherwise, the foot may easily get cold. Moreover, dirt, small pebbles or snow may enter the shoe via the opening.

In the prior art, gaiters are typically used to seal the opening between the shoe upper and the wearer's foot/leg. However, gaiters are cumbersome to carry and/or to attach to the shoe. Moreover, they need to be tightened around the shanks and, if tightened too strongly, the use of gaiters may lead to bruises. If, on the other hand, they are only loosely tightened, the gaiters will slide downwards such that they have to be frequently readjusted. Moreover, gaiters may easily get stuck when hiking through rocky or bushy ground.

Another solution is to provide a shoe with a collar. In the prior art, sometimes bulky collars are arranged above the shoe's heel portion. They may extend around the ankle region of the foot and may be tightened to close the gap between shoe and ankle. Bulky collars are used in that context such that, despite the required tightening, a reasonably soft contact with the ankle is enabled. Such bulky collars may reasonably seal the shoe from any objects. However, the bulky collars increase the shoes' weight which is particularly disadvantageous for hiking where literally every additional gram is a large burden and avoided by a hiker.

In addition, there are prior art collars that are somewhat elastic. However, prior art elastic collars are often arranged to serve as an auxiliary means for putting on the shoe without being adapted for sealing the interface between shoe and ankle. Moreover, even if provided for sealing purposes, such elastic collars often do not sufficiently close the gap between the shoe and the ankle.

Therefore, it is the problem underlying the present invention to improve the sealing of shoes, particularly hiking shoes.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a shoe comprises a rigid heel portion, and a collar arranged above the rigid heel portion, the collar comprising a first collar portion and a second collar portion, the first collar portion and the second collar portion configured to partially engage an ankle of a wearer of the shoe on a lateral side, a medial side, and a rear side of the ankle when worn, wherein the first collar portion is more flexible than the rigid heel portion and wherein the second collar portion is more flexible than the first collar portion.

In some embodiments, the second collar portion is stretchable and adapted to sealingly partially engage the ankle on the medial side, the lateral side and the rear side of the ankle. A thickness of the first collar portion may be increased by at least 50% or at least 100% compared to a thickness of the second collar portion.

In some embodiments, the collar comprises an inner layer and an outer layer. The inner layer and the outer layer may be connected via hot-pressing. According to some embodiments, the collar does not comprise any seam. The outer layer may comprise a rip stop fabric and/or the inner layer may comprise a lining. In certain embodiments, the first collar portion and the second collar portion each comprise a foam layer between the inner and the outer layer.

According to some embodiments, an opening provided by the second collar portion may be smaller than an opening provided by the first collar portion.

In certain embodiments, the shoe further comprises a tongue, the tongue comprising a first tongue portion and a second tongue portion, wherein the second tongue portion is more flexible than the first tongue portion. The second collar portion and the second tongue portion may be adapted to sealingly engage the ankle on the medial side, the lateral side, the rear side and the front side of the ankle.

A thickness of the first tongue portion may be increased by at least 50% or at least 100% compared to a thickness of the second tongue portion. A thickness of the second tongue portion may be reduced compared to a thickness of the second collar portion.

BRIEF DESCRIPTION OF THE DRAWINGS

In the following detailed description, embodiments of the invention are described referring to the following figures.

BRIEF DESCRIPTION

Figure 1:
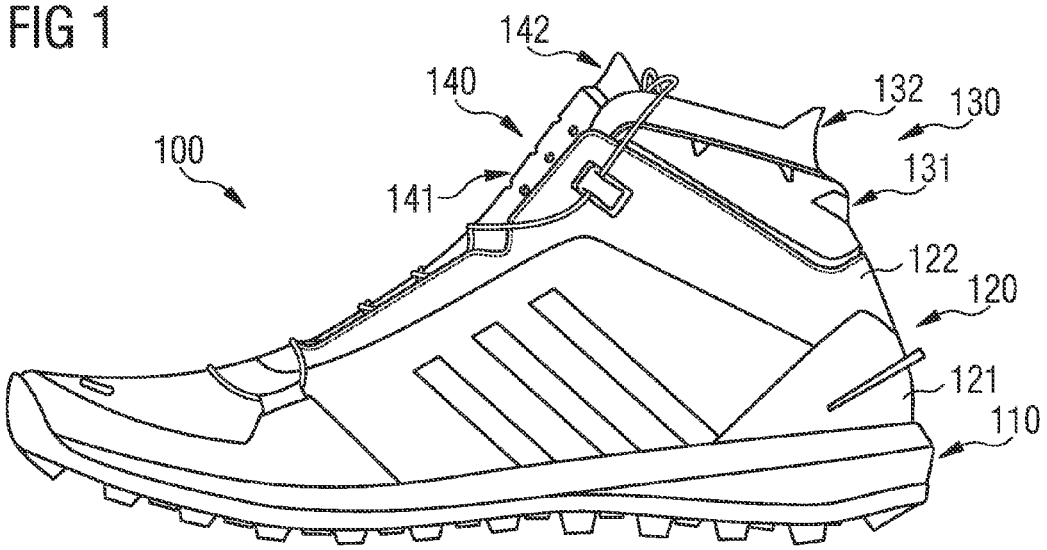
FIG. 1 is a lateral view of a hiking shoe, according to certain embodiments of the present invention.

In certain embodiments, the sealing of a shoe is improved by a shoe, particularly a hiking shoe, which comprises a rigid heel portion and a collar arranged above the rigid heel portion, wherein the collar comprises a first collar portion and a second collar portion. The first collar portion and the second collar portion are configured to partially engage an ankle of a wearer of the shoe on a lateral side, a medial side, and a rear side of the ankle when worn. The first collar portion is more flexible than the rigid heel portion and the second collar portion is more flexible than the first collar portion.

By the combination of a collar that partially engages the ankle of the wearer on three sides and the varying flexibility of the two collar portions, a two-step sealing of the gap between the shoe and the ankle of the wearer is provided. The rigid heel portion provides the shoe with stability, as particularly required for hiking applications. The first collar portion, which is more flexible than the heel portion and arranged above the heel portion, serves as a first sealing mechanism that partially engages the ankle of the wearer on three sides. By the second collar portion, which is even more flexible than the first collar portion, a further refined sealing is provided. The increased flexibility of the second collar portion allows for a particular good adaptation of the collar to the ankle and/or lower leg and the movements thereof.

The second collar portion may adapt to the shape of the ankle and/or lower leg without being too loose since, below the second collar portion, a first, less flexible portion is provided. The two collar portions and their graded flexibility provide a particularly tight sealing which prevents objects, such as small stones, from entering the shoe. It also ensures a good heat insulation of the interior of the shoe.

At the same time, the graded flexibility of the collar may be particularly comfortable to the wearer. The different flexibilities of the two collar portions may compensate the different degrees of movements of the different portions of the foot/ankle/leg relative to the shoe during walking. For example, the position of the ankle within the shoe changes very little, if at all, during walking. However, the shanks (the supportive structure in a shoe between the insole and outsole) move forward and backward relative to the shoe. In particular, those parts of the shanks which are further away from the ankle move further. The second collar portion is arranged above the first collar portion, and thus further away from the ankle than the first collar portion. Hence the second collar portion experiences a greater movement of the leg which, due to the increased flexibility of the second collar portion, may be compensated. The reduced flexibility of the first collar portion, in turn, may reflect the smaller movement that needs to be compensated by the first collar portion which is closer to the ankle. As a result, a particularly tight and also comfortable sealing may be provided during all phases of walking.

A collar according to the present invention is understood as an essentially self-supporting portion of the shoe, in contrast e.g. to gaiters which collapse without being fixed at their top. In some embodiments, the collar partially engages the ankle along a perimeter of at least 120°, in some embodiments of at least 180°, of at least 240°, or of at least 270°, in some embodiments even of at least 300°.

In some embodiments, the second collar portion is stretchable and adapted to sealingly partially engage the ankle on the medial side, the lateral side and rear side of the ankle. Since the second collar portion is stretchable, it may be designed such as to provide an opening for the foot/ankle/leg of the wearer which is slightly narrower than required to partially engage the ankle. The second collar portion slightly stretches if the shoe is put on, and hence naturally adapts to the individual contours of the ankle and/or lower leg. Therefore, on all three sides of the ankle, a tight sealing is ensured.

According to a further aspect, a thickness of the first collar portion may be increased by at least 50%, or at least 100%, compared to a thickness of the second collar portion. By such an increase in thickness from the second collar portion to the first collar portion, the varying degrees of movement of the foot/ankle/leg may be taken into account. The second collar portion experiences a more pronounced movement and thus has to move/bend to a greater extent. This may be facilitated by its reduced thickness. On the other hand, the first collar portion's increased thickness helps to improve the heat insulation of the collar. What is more, such an arrangement may provide a particularly improved wearing comfort. According to certain embodiments, the ratio of the thickness of the second collar portion to the thickness of the first collar portion is in the range of 30%-80%, or 40%-70%.

The increase in thickness from the second to the first collar portion may be combined with different openings for the wearer's ankle provided by the first and second collar portions. The opening of the first collar portion may be wider than that of the second collar portion. The wider opening and the greater thickness of the first collar portion may provide a particularly tight fitting of the collar to the wearer's ankle such that the heat insulation and the wearing comfort are improved.

Although the thickness and height of a collar and its portions may vary, according to an aspect, the ratio of a greatest thickness of the collar compared to its greatest height is in the range of 5%-50%, or in the range of 10%-20%. Similarly, the ratio of a greatest thickness of the collar compared to its average height is, according to an aspect, in the range of 5%-50%, or in the range of 10%-20%. The greatest height of the collar is, in some embodiments, provided in the heel region. In various embodiments, the greatest height is in the range of 40 mm to 80 mm, or in the range of 50 mm to 70 mm. In some embodiments, the greatest thickness is in the range of 4 to 15 mm, or in the range of 7 to 12 mm.

According to further embodiments, the collar comprises an inner layer and an outer layer. Particularly, the inner layer may be different from the outer layer. According to certain embodiments, the inner and outer layers of the collar form the inner and outer surfaces, respectively, of the collar. Hence, these layers may provide different properties to the inner and outer surface of the collar. For example, the outer layer may be particularly waterproof, tear proof and/or abrasion resistant. The inner layer may be adapted to provide a comfortable feel to the wearer's foot/ankle. Hence, the inner and outer surface of the collar may be functionalized and designed differently.

According to further embodiments, the inner and the outer layer of the collar are connected via hot-pressing. Hot-pressing provides a particularly economical manufacturing method allowing mass-production, and at the same time a large variability of materials and customization options. Moreover, the hot-pressing of the inner and outer layer provides a durable connection which is suitable also for rough outdoor conditions as typically required for hiking shoes.

According to further embodiments, the collar does not comprise any seam. This may, for example, be achieved by hot-pressing the inner and outer layers of the collar. Seams often lead to pressure marks and bruises since they cause friction and extra pressure on the wearer's foot/ankle. By avoiding a seam in the collar, such bruises and pressure marks are prevented. This is particularly beneficial since, in the collar region, a lot of relative movement between the leg/foot and the shoe occurs. Therefore this region is particularly susceptible to bruises caused by friction and irregularities in the pressure distribution which would be caused by a seam.

According to further embodiments, the outer layer of the collar comprises a rip stop fabric. By using rip stop fabric, the collar may be adapted to be particularly durable. In particular for outdoor applications, where the collar may contact rocks or harsh bushes, this may be beneficial since a ripping or tearing of the collar may be prevented. Moreover, the rip stop fabric may be reliably connected via hot-pressing.

According to further embodiments, the inner layer of the collar comprises a lining. Through the lining provided on the inside of the collar, a particularly comfortable collar may be provided. In some embodiments, the inner layer comprising the lining and the outer layer comprising the rip stop fabric are connected in a single heat pressing step allowing for an efficient manufacturing. The lining may be abrasion-resistive such as to provide a durable inner layer.

According to further embodiments, the first collar portion and the second collar portion each comprise a foam layer between the inner and the outer layer. The inner layer, the outer layer and the foam layers may be connected to each other in a single hot-pressing step. Hence, a particularly simple fabrication method may be used for producing the collar. At the same time, by simply varying the geometries of the foam layers between the inner and outer layers, the geometries and/or properties of the first collar portion and the second collar portion may be controlled. For example, the first collar portion may comprise a foam layer with a greater thickness than a foam layer of the second collar portion. For example, the foam layer of the first collar portion may be 50% thicker than the foam layer of the second collar portion. In other embodiments, the foam layer of the first collar portion may be twice, or at least twice, as thick than the foam layer of the second collar portion.

The foam layers of the first collar portion and the second collar portion may be formed, e.g. via hot-pressing, by two or more pieces of foam. In some embodiments, a first piece of foam extends throughout the first collar portion and the second collar portion, and a second piece of foam is only located in the first collar portion. The second piece of foam may be placed on top of the first piece of foam during manufacturing. Hence, a thicker layer may be provided in the first collar portion via the first piece of foam and the second piece of foam located in the first collar portion. In some embodiments, the first piece of foam extends essentially throughout the entire collar. In an aspect, the first piece of foam and the second piece of foam form a homogeneous layer of foam in the first collar portion after hot-pressing. In some embodiments, the second piece of foam comprises a thickness of at least 50% of the thickness of the first piece of foam. In some embodiments, the thickness of the first piece is the same as that of the second piece of foam. This may allow cutting both pieces of foam from a same foam sheet.

Additionally and/or alternatively, different foams may be used for the different foam layers such that the properties and geometries of the first and second collar portions may be controlled individually. By using only foam layers, an inner and outer layer may provide a particularly lightweight collar.

According to further embodiments, an opening provided by the second collar portion is smaller than an opening provided by the first collar portion. In other words, the second collar portion partially engages the lateral, medial and rear sides of the ankle more tightly than the first collar portion. A particularly tight sealing may thus be provided, following the anatomy of the wearer's foot/ankle/leg. In particular, when combined with a stretchable second collar portion, excellent sealing properties are obtained.

According to another aspect, the shoe further comprises a tongue, wherein the tongue comprises a first tongue portion and the second tongue portion. The second tongue portion is more flexible than the first tongue portion. By providing such a tongue, similarly as described with respect to the collar, an improved sealing may also be obtained in the front side of the ankle such that a fully circumferential sealing of the entire gap between the shoe and the ankle of the wearer is provided.

In further embodiments, the second collar portion and the second tongue portion are adapted to sealingly engage an ankle on the medial side, the lateral side, the rear side, and the front side of the ankle. As a result, the flexible second collar and tongue portions may provide a full circularly shaped sealing all around the circumference of the user's ankle/leg. Improved heat insulation is thus provided, and objects such as stones and snow are prevented from entering the shoe at all sides of the ankle.

According to further embodiments, a thickness of the first tongue portion is increased by at least 50%, or at least 100%, compared to a thickness of the second tongue portion. Similarly, as described with respect to the collar portions, the increase in thickness may lead to an improved sealing since it may follow the varying degrees of movement of the wearer's foot/ankle/leg relative to the shoe. Moreover, the increased thickness of the first tongue portion may increase the wearing comfort since it may relieve the ankle from pressure provided by the laces which are typically arranged around the tongue.

According to further embodiments, a thickness of the second tongue portion is reduced compared to a thickness of the second collar portion. This may lead to a particularly good wearing comfort and reduce bruises around the full seal provided by the collar together with the tongue. This is, since the second tongue portion and the second collar portion may partly overlap in order to provide a tight seal. Reducing the thickness of the second tongue portion thus reduces the combined thickness of the seal in such overlapping areas such that unnecessary pressure is avoided.

According to further embodiments, the sealing of a shoe is improved by a shoe, particularly a sports shoe, comprising a rigid heel portion and a collar arranged above the rigid heel portion, wherein the collar is more flexible than the rigid heel portion. The collar is configured to partially engage an ankle of a wearer of the shoe on the rear side, the lateral side, and the medial side when worn. The collar comprises an inner layer and an outer layer connected by hot-pressing, wherein the collar does not comprise any seam. Hence, bruises and pressure marks due to a seam may be prevented and a more economical fabrication process may be used, as described earlier. Further aspects described in the previous paragraphs may also be combined with this example, to provide further aspects.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

In the following detailed description, certain embodiments are described with respect to shoes and hiking shoes.

FIG. 1 shows embodiments of a hiking shoe 100. The hiking shoe 100 comprises a sole 110. Moreover it comprises a rigid heel portion 120. The rigid heel portion 120 is particularly adapted as a rugged heel portion for protecting the heel of the wearer's foot for outdoor applications. The rigid heel portion 120 comprises a first heel portion 121 and a second heel portion 122. The first heel portion 121 comprises hard plastic to protect the foot.

The shoe 100 further comprises a collar 130. The collar 130 is arranged above the rigid heel portion 120. The collar 130 comprises a first collar portion 131 and a second collar portion 132, which is arranged above the first collar portion 131. The collar 130 is configured to partially engage the wearer's ankle around the medial, rear, and lateral sides when worn.

In the embodiments of hiking shoe 100, the opening provided for the wearer's ankle by the second collar portion 132 is reduced compared to that opening provided by the first collar portion 131. The thickness of the first collar portion 131 is increased compared to the thickness of the second collar portion 132. The height of the first collar portion 131 is relatively large on the rear side of the ankle and reduces from the rear side of the ankle along both the lateral side and the medial side of the ankle. The height of the second collar portion 132 is relatively constant along the lateral and medial sides of the ankle. At the rear side of the ankle, the second collar portion 132 comprises an extension which may simplify putting on the shoe 100. Some or all of the geometrical aspects may be designed differently in other embodiments. In some embodiments, the second collar portion 132 is stretchable and adapted to sealingly partially engage a wearer's ankle.

The hiking shoe 100 further comprises a tongue 140. The tongue 140 comprises a first tongue portion 141 and a second tongue portion 142. The second tongue portion 142 is arranged above the first tongue portion 141. The thickness of the first tongue portion 141 is increased compared to the thickness of the second tongue portion 142. The first tongue portion 141 comprises a plurality of circular recesses. In other embodiments, such recesses may not be provided or other forms of recesses, such as rectangular or oval recesses, etc., may be provided. The dimensions of the tongue 140 and its first and second portions 141 and 142, respectively, are adapted such that the second tongue portion 142 and the second collar portion 132 provide a full circumferential sealing of the gap between the shoe 100 and the wearer's ankle. The same applies to the first tongue portion 141 and the first collar portion 131, which provide a second circumferential sealing around the full circumference of the wearer's ankle. A particularly improved sealing of the shoe 100 from external objects such as small stones or snow or dirt is thus ensured. At the same time, heat retention is provided by the fully circumferential two-step seal provided by the first and second collar portions 131 and 132 and the first and second tongue portions 141 and 142. While the described tongue 140 may be desirable in certain embodiments, other embodiments may be provided without tongue 140.

The shoe 100 also comprises laces and a mechanism for attaching the laces to the shoe. The mechanism for attaching the laces is not attached to the collar 130 of hiking shoe 100. In other embodiments, the collar 130 may also comprise a mechanism for attaching laces, as will be described for example with reference to FIG. 7 below.

Figure 2A:
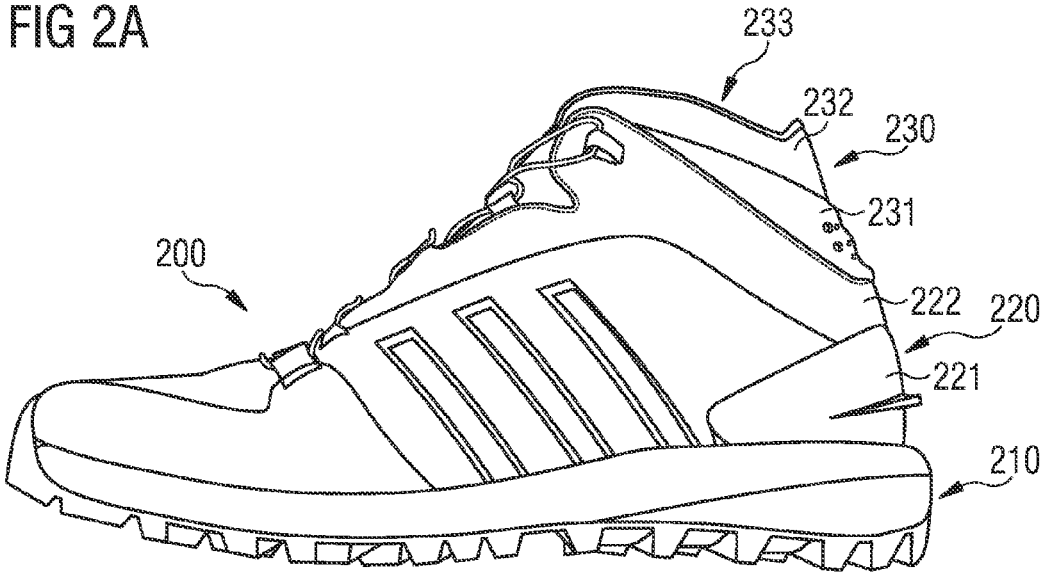
FIGS. 2A-C are medial, rear, and lateral views of a hiking shoe, according to certain embodiments of the present invention.
Figure 2B:
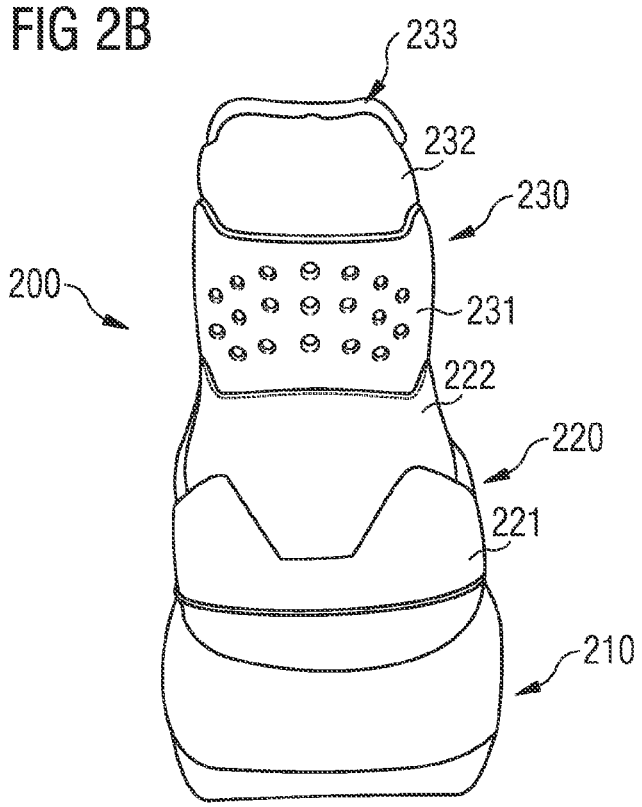
Figure 2C:
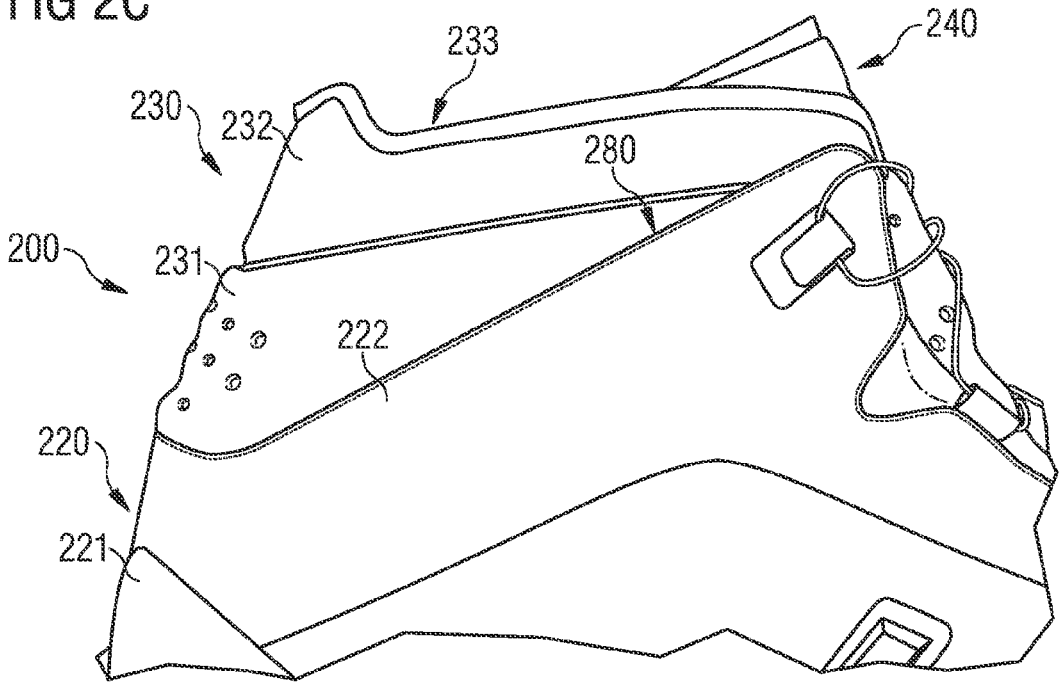

FIGS. 2A, 2B and 2C show further embodiments of a hiking shoe 200. As shown in FIG. 2A, the hiking shoe 200 comprises a sole 210 and a rigid heel portion 220. The rigid heel portion 220 comprises a first heel portion 221 and a second heel portion 222. Moreover, the hiking shoe 200 comprises a collar 230. The collar 230 comprises a first collar portion 231 and a second collar portion 232. In these aspects, the hiking shoe 200 is similar to the hiking shoe 100 of FIG. 1.

In addition, the first collar portion 231 of shoe 200 comprises circular recesses in the region of the Achilles tendon. These recesses may provide the first collar portion 231 with increased stability in this sensitive region of the ankle/foot. Moreover, the collar 230 of shoe 200 optionally comprises a third collar portion 233, which is arranged above the second collar portion 232. The height of the third collar portion 233 is smaller than the height of the second collar portion 232. In the shoe 200, the height of the third collar portion 233 is substantially constant around the lateral, rear and medial sides of the ankle. In some embodiments, the height comprises less than 10 mm; and the height may further be in the range of 1-6 mm. In other embodiments, the height of the third collar portion 233 may vary along the lateral, rear, and/or medial sides of the shoe. The third collar portion 233 may further help to tighten the seal provided by the collar.

FIG. 2B is a rear view representation of the hiking shoe 200. As can be seen, the collar 230, including the first collar portion 231, the second collar portion 232 and the third collar portion 233 partially engages the wearer's ankle on the rear side of the shoe and seamlessly extends around the medial and lateral sides of the ankle.

FIG. 2C shows a close-up view of the lateral side of the hiking shoe 200. As can be seen, the collar portion 230 is attached to the shoe by a seam 280. The collar itself, however, does not comprise any seam. In other embodiments, the collar may be attached to the shoe without a seam, for example by hot-pressing or gluing.

The hiking shoe 200 further comprises a tongue 240. The tongue 240 is substantially similar to the tongue 140 described with respect to hiking shoe 100. First and second tongue portions of the tongue 240 may be adapted to provide a full circumferential seal around the wearer's ankle together with the first collar portion 231 and the second collar portion 232, respectively. Moreover, the tongue 240 may comprise a third tongue portion which is adapted to align with the third collar portion 233 for a full circumferential sealing of the ankle. In other embodiments, such a tongue 240 may not be provided.

Figure 3A:
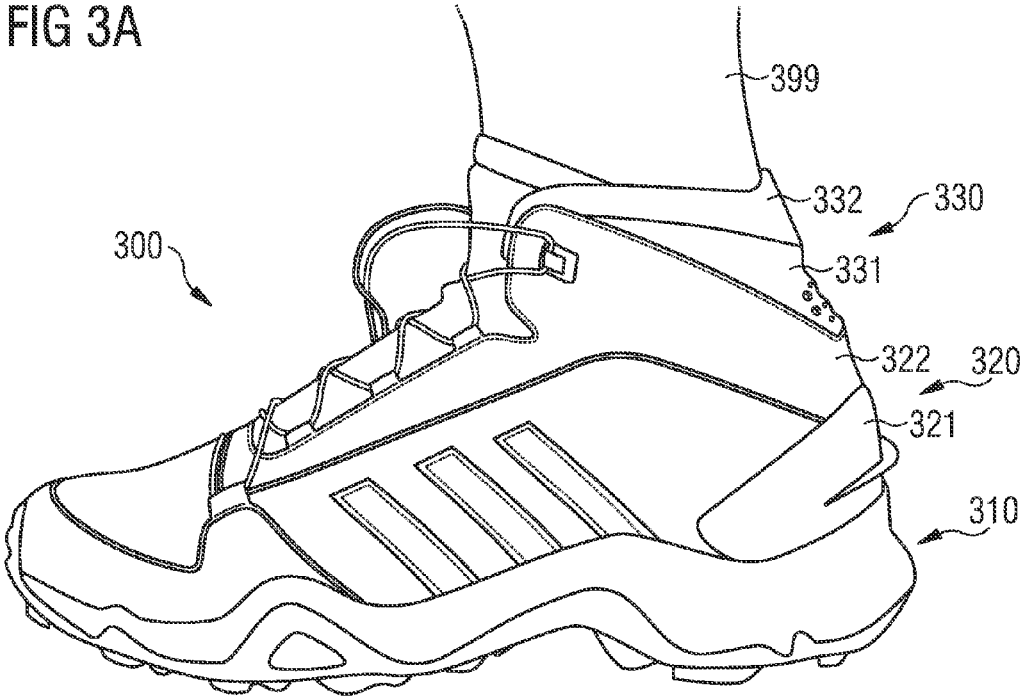
FIGS. 3A-B are lateral views of a hiking shoe for different leg positions, according to certain embodiments of the present invention.
Figure 3B:
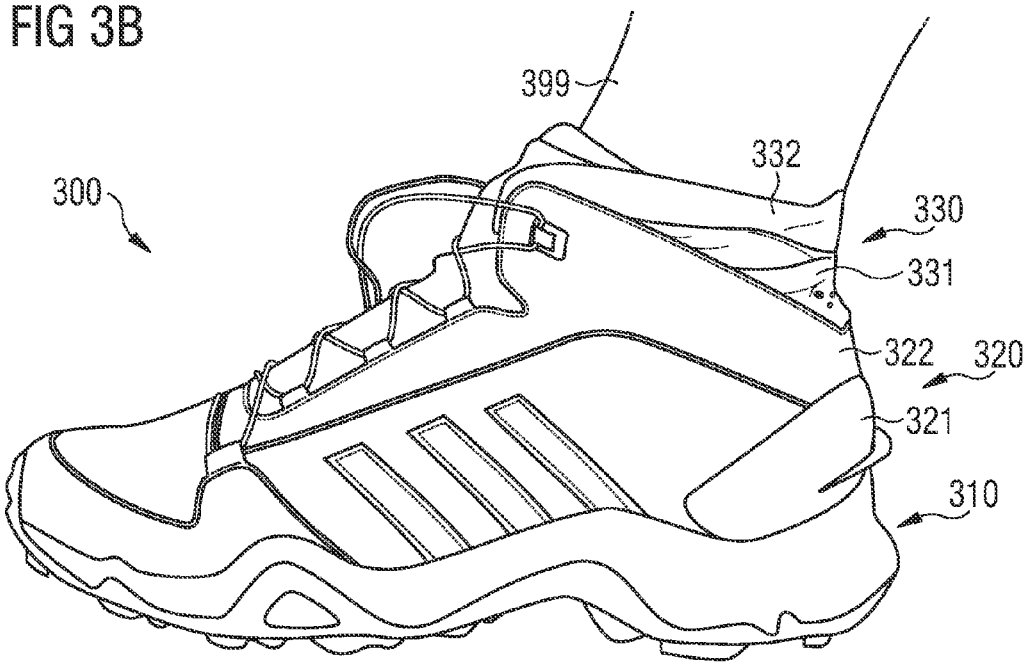

FIGS. 3A and 3B show further embodiments of a hiking shoe 300. The hiking shoe 300 comprises a sole 310. Moreover, the hiking shoe 300 comprises a rigid heel portion 320, which in turn comprises a first heel portion 321 and a second heel portion 322. Moreover, the shoe 300 comprises a collar 330. The collar 330 comprises a first collar portion 331 and a second collar portion 332. The second collar portion 332 is arranged above the first collar portion 331. Both the first collar portion 331 and the second collar portion 332 partially engage the ankle of the foot/the lower leg 399 of the wearer around the rear side of the ankle, the lateral side of the ankle and the medial side of the ankle. The second collar portion 332 is more flexible than the first collar portion 331, which is in turn more flexible than the rigid heel portion 320. The first collar portion 331 comprises a plurality of recesses in the region of the Achilles tendon to provide increased stability. In other embodiments, different recesses or no recesses are provided.

As can be seen from FIGS. 3A and 3B, the wearer's leg, when walking, rotates around the horizontal axis through the ankle of the foot. This leads to a greater movement of those portions of the leg, which are further away from the ankle. Via the arrangement of the collar with a first collar portion 331 and a second collar portion 332, the collar provides a tight sealing of the gap between the ankle of the wearer and shoe in all phases of movement during walking.

The collar is arranged such that it approximately follows the shape of the leg when the leg is arranged approximately along a vertical line above the shoe. By the varying degree of flexibility, the collar maintains a tight sealing along all three sides even if the leg moves forward or backward. Since the second collar portion 332 is arranged further away from the ankle than the first collar portion 331, it needs to adapt more strongly during walking. This is achieved by its increased flexibility compared to the first collar portion 331. This increased degree of flexibility may be accompanied, in some embodiments, by a reduced thickness in the second collar portion 332 compared to the first collar portion 331 and/or a stretchability of the second collar portion 332. In some embodiments, the first collar portion may also be stretchable, but may be less stretchable than in the second collar portion.

By providing a tongue of the shoe 300 with first and second tongue portions, a tight seal may also be provided at the front side of the ankle during all phases of movement of the foot/ankle/leg. This aspect will be further described with reference to FIGS. 8A-C.

Figure 4A:
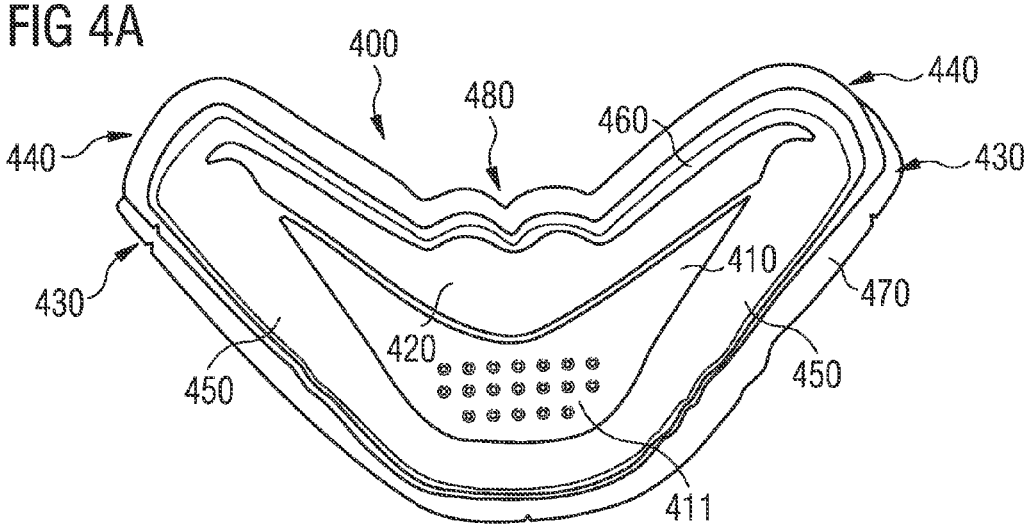
FIGS. 4A-C are top, partial, and bottom views of a collar member for providing a heel portion for a shoe, according to certain embodiments of the present invention.
Figure 4B:
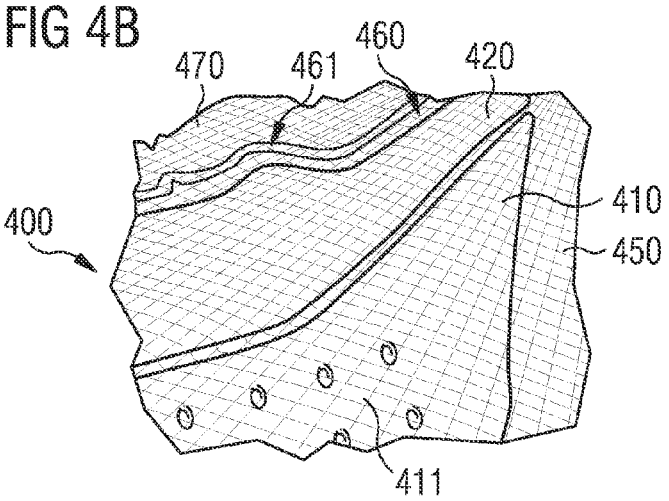
Figure 4C:
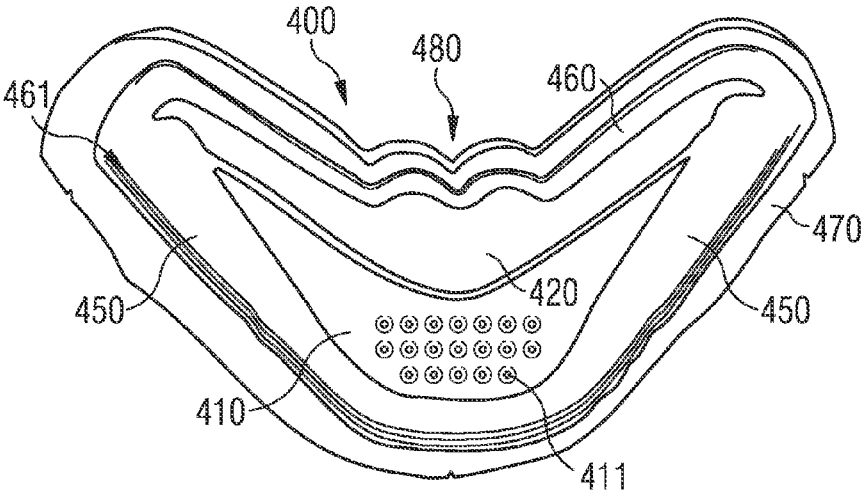

FIGS. 4A, 4B and 4C show a collar member 400, which may be used to provide a collar according to certain embodiments. The collar member 400 comprises a first collar portion 410 and a second collar portion 420. Both collar portions 410 and 420 are adapted such as to partially engage the ankle of the wearer around the lateral, medial, and rear sides of the ankle. The second collar portion 420 is adapted to be arranged above the first collar portion 410.

The collar member 400 comprises an inner layer 430, which is arranged to form the inner surface of the collar. The inner layer 430 comprises a lining. In other embodiments, other materials may be used for the inner layer 430. Moreover, the collar member 400 comprises an outer layer 440, which is arranged to form an outer layer of the collar provided by the collar member 400. The outer layer 440 comprises a rip stop fabric. The structure of the rip stop fabric is depicted in more detail in FIG. 4B. The rip stop fabric, in the embodiments of FIG. 4B, exhibits a structure of squares which provides reinforcement such that a ripping of the outer layer 440 is prevented. However, other reinforcement structures may also be used.

With reference to FIG. 4A, it can be seen that the inner layer 430 and the outer layer 440 are connected to each other. The outer layer forms the outer surface of the collar member 400, as can be seen from the top-view of the collar member 400 in FIG. 4*a*. The inner layer 430 and the outer layer 440 form the inner, respectively outer surface of the first collar portion 410, the second collar portion 420, a third collar portion 460 which is arranged above the second collar portion 420, and an attachment portion 450 which serves as a portion for attaching the collar member 400 to a shoe. For example, the collar member 400 may be sewn to the shoe or it may be hot-pressed or simply glued to the shoe by the attachment portion 450. By using attachment portion 450 of collar member 400, the collar, including the first, second and third collar portions 410, 420, 460, but not including attachment portion 450, may be arranged fully above the rigid heel portion.

The collar member 400 is also provided with an embossed rim 461, which circumscribes the collar member 400. The parts of the inner layer 430 and the outer layer 440 within and including the embossed rim 461 are connected to each other by hot-pressing. The parts of the inner layer 430 and the outer layer 440 outside the embossed rim 461 are not connected with each other and designated with the reference number 470. These parts 470 may be removed from the collar member 400 before attachment to the shoe. In FIG. 4B, a close-up view of the embossed rim 461 is provided. In other embodiments, no such embossed rim is provided.

As can be seen in FIG. 4B, the first collar portion 410 may be provided with recesses 411, to reinforce the first collar portion 410. These recesses may be arranged in the region that will be above the Achilles tendon after attachment of the collar member to the shoe. In other embodiments, no recesses may be provided, the recesses may be arranged differently and/or also in the second collar portion.

FIG. 4C shows the inner surface of the collar member 400. The inner surface is formed by the inner layer 430, which may comprise a lining. As can be seen from FIG. 4A, the first and second collar portions 410 and 420, respectively, on the outer surface of the collar member 400 are extruded above the surface of the outer layer. On the inner surface, the collar member may be flat such as to provide a pleasant wearing comfort to the wearer.

As can be seen in FIGS. 4A and 4C, the collar member 400 comprises a heel pattern 480. The heel pattern 480 comprises two elevated regions equally spaced to the left and to the right side, respectively, of a node centered with respect to the rear side of the wearer's foot. This serves to safely seal the region around the Achilles tendon. However, in other embodiments, different heel patterns may be provided.

Figure 5A:
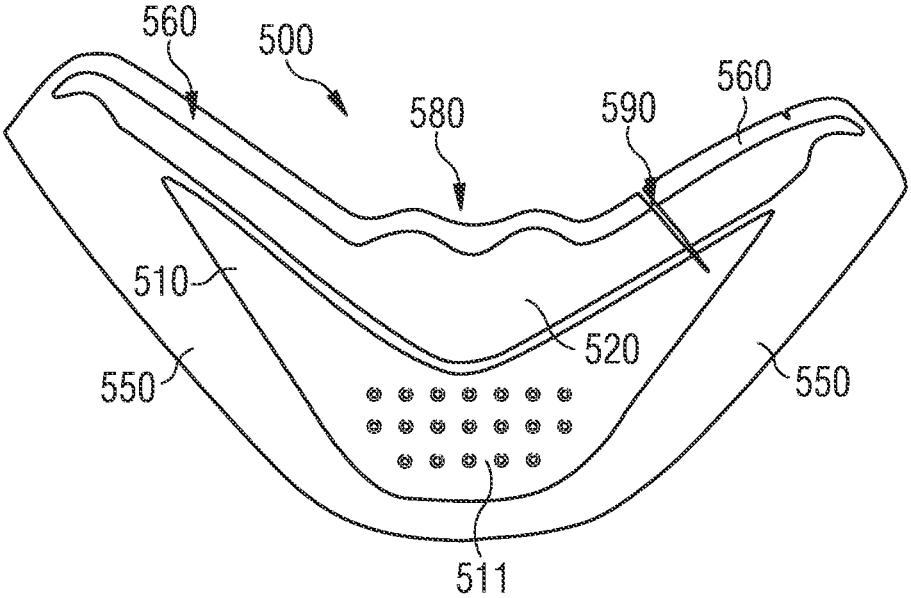
FIGS. 5A-B are top and bottom views of a collar member for providing a heel portion for a shoe, according to certain embodiments of the present invention.
Figure 5B:
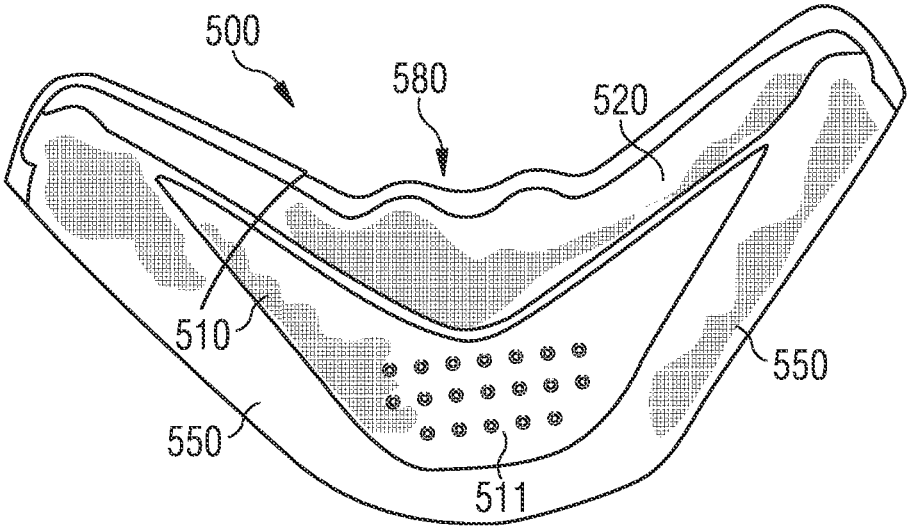

Further embodiments of a collar member 500 adapted to provide a collar are shown in FIGS. 5A and 5B. The collar member 500 comprises a first collar portion 510 and a second collar portion 520. The first collar portion 510 optionally comprises a plurality of recesses 511.

The collar member 500 comprises a third collar portion 560 arranged above the second collar portion 520, which is in turn arranged above the first collar portion 510. The third collar portion 560 is more flexible than the second collar portion 520, which is in turn more flexible than the first collar portion 510. The collar member 500 further comprises a portion 550, which serves for attaching the collar member to the shoe. This attachment portion 550 is arranged below the first collar portion. The collar member 500 further comprises a heel pattern 580, which is substantially similar to the heel pattern 480 provided by collar member 400.

FIG. 5A is a view of the surface of the collar member 500, which will form the outer face of the collar. This outer surface of the collar member is formed by an outer layer comprising a rip stop fabric. The reference number 590 in FIG. 5A indicates a cut through the collar member 500 whose cross-sections are depicted in FIGS. 6A and 6B.

FIG. 5B shows the opposing side of the collar member 500, which will form the inner surface of the collar. This side of the collar member 500 is formed by an inner layer comprising a lining.

Figure 6A:
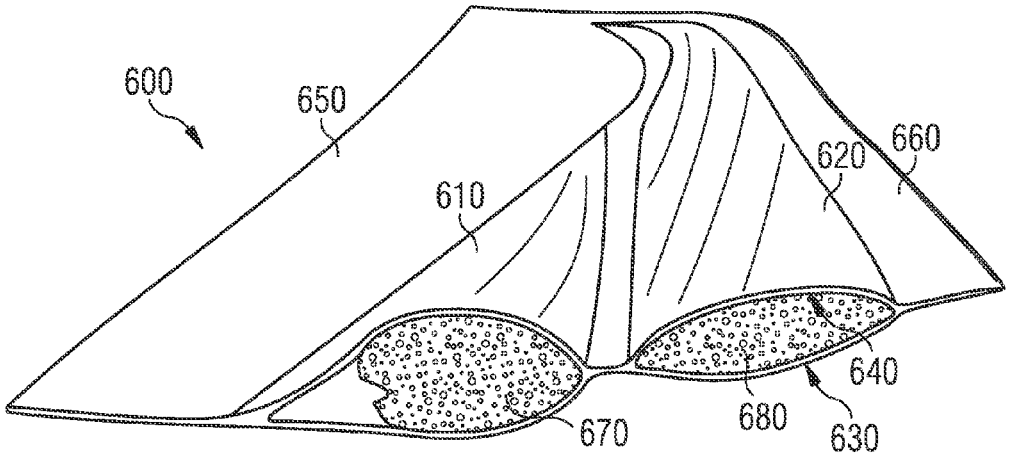
FIGS. 6A-B are cross-sectional views of the collar member of FIGS. 5A-B.
Figure 6B:
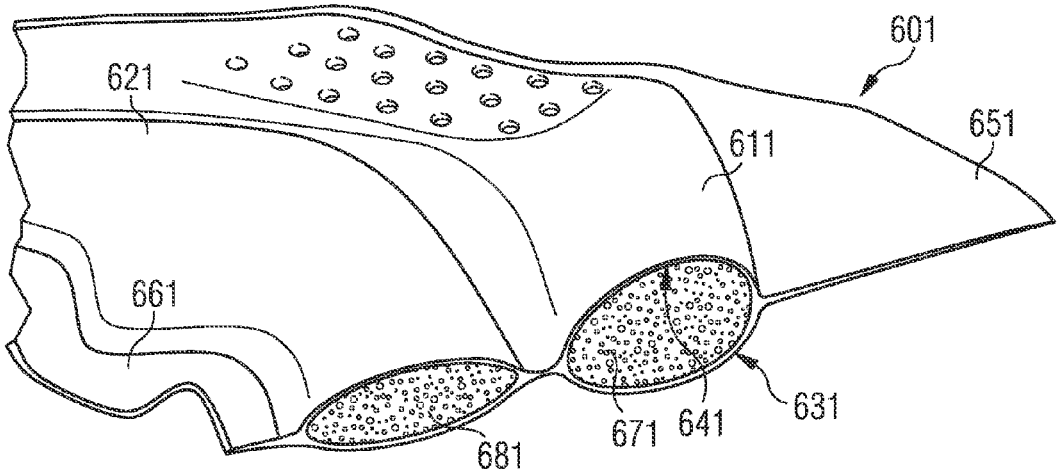

FIGS. 6A and 6B show cross-sectional views of the parts 600 and 601, created by cutting collar member 500 along the cut-line 590 of FIG. 5A. In the following, the elements of the two parts 600 and 601 will be referred to as if they were separate elements for clarity. However, it should be noted that corresponding elements of parts 600 and 601 together form the respective element of the collar member 500.

The first part 600, which is depicted in FIG. 6A, comprises an inner layer 630 and an outer layer 640 connected by hot-pressing. The connected layers 630, 640 form the third collar portion 660. Moreover, they form the attachment portion 650, which may be used for attaching the collar member to a shoe.

Moreover, the first part 600 comprises a first collar portion 610 and a second collar portion 620. The first collar portion 610 is formed by a layer of foam 670 enclosed within respective portions of the outer layer 630 and the inner layer 640. Similarly, the second collar portion 620 is formed by portions of the inner layer 630 and the outer layer 640 with a layer of foam 680 in between.

The layer of foam 670 of the first collar portion has a greater thickness than the layer of foam 680 of the second collar portion such that the first collar portion 610 is provided with a greater thickness than the second collar portion 620. The thickness of the layer of foam 670 of the first collar portion 610 is at least increased by 50%. In certain embodiments, it is approximately doubled compared to the thickness of the layer 680 of the second collar portion 620.

In some embodiments, the thickness of the first collar portion may be 14-18 mm, and may further be approximately 16 mm. The thickness of the second collar portion may be 6-10 mm, and may further be approximately 8 mm, or may be 8-12 mm, and may further be approximately 10 mm.

According to further embodiments, the thickness of the first collar portion may be 12-16 mm, and may further be approximately 14 mm. The thickness of the second collar portion may be 6-10 mm, and may further be approximately 8 mm. These thicknesses may for example be provided by using a first piece of foam and a second piece of foam placed on top of the first piece of foam with corresponding thicknesses before a hot-pressing step, as explained earlier.

The height of the layer of foam 680 of the second collar portion 620, i.e. its lateral dimension in FIG. 6A, is greater than that of the foam layer 670 of the first collar portion 610. However, in other embodiments, different height and thickness relationships may be used.

In the embodiments of collar member part 600, the same foam is used for the first and second collar portions 610 and 620, respectively. In other embodiments, different foams may be used.

The foam layers may be manufactured from two or more separate pieces of foam, which are arranged in between the inner and outer layer of the collar member before hot-pressing. The pieces may be arranged on top of each other and/or next to each other. In some embodiments, each piece of foam comprises self-adhesive such that a particularly good connection is provided after hot-pressing. The pieces of foam may form a homogeneous layer in the first collar portion and in the second collar portion after hot-pressing. Moreover, in certain embodiments, a hot melt adhesive is used at least in areas not comprising foam. In further embodiments, the hot melt adhesive forms a complete layer between the inner and outer layers of the collar member and reacts upon heat and pressure. A particularly durable bonding between inner and outer layer may thus be provided after hot-pressing.

FIG. 6B shows the second part 601 of the collar member 500, which together with the first part 600 forms the collar member 500. Similarly as the first part of the collar member, the second part of the collar member 601 comprises an inner layer 631 and an outer layer 641 and foam layers 671 and 681. Moreover, the second part of the collar member comprises a first collar portion 611, a second collar portion 621 and a third collar portion 661, which together with the respective portions of the first part 600 provide the respective portions of collar member 500. Finally, the second part 601 also comprises a portion 651 for attachment to the shoe.

The collar formed by the collar member 500 comprises the first collar portion 510, the second collar portion 520 and a third collar portion 560. As can be seen from FIGS. 6A and 6B, the greatest thickness of the collar is smaller than the height of the collar. More specifically, in the embodiments of FIGS. 6A and 6B, the greatest thickness of the collar is approximately 20% of its height. The height is understood as an average height averaged along the lateral, the rear, and the medial sides of the ankle. Moreover, the greatest thickness of the collar comprises approximately 15% of the greatest height of the collar. In certain embodiments, the greatest height of the collar is provided in the heel region, as in the collar member 500. Similar ratios of the greatest thickness of the collar compared to its average height or compared to its greatest height may be provided in other embodiments.

Further embodiments of a collar member 700 will now be described with reference to FIG. 7. Collar member 700 comprises a first collar portion 710 and a second collar portion 720 arranged above the first collar portion 710. The collar member also comprises a third collar portion 760, which is arranged above the second collar portion 720. Moreover, the collar member 700 comprises a portion 750 which is provided for attaching the collar to the shoe.

Further, the collar member 700 comprises an embossed rim 761, which circumscribes the collar member 700. The collar member 700 moreover comprises an inner layer and an outer layer, which are connected to each other in the area within and comprising the embossed rim 761. In other embodiments, the inner and outer layers may be connected without having an embossed rim at the edges of the connected areas.

The collar member 700 further comprises a lace portion 780, which is adapted for attaching shoe laces. While not depicted in FIG. 7, a lace portion 780 may be arranged on both sides of the collar member 700.

Figure 7:
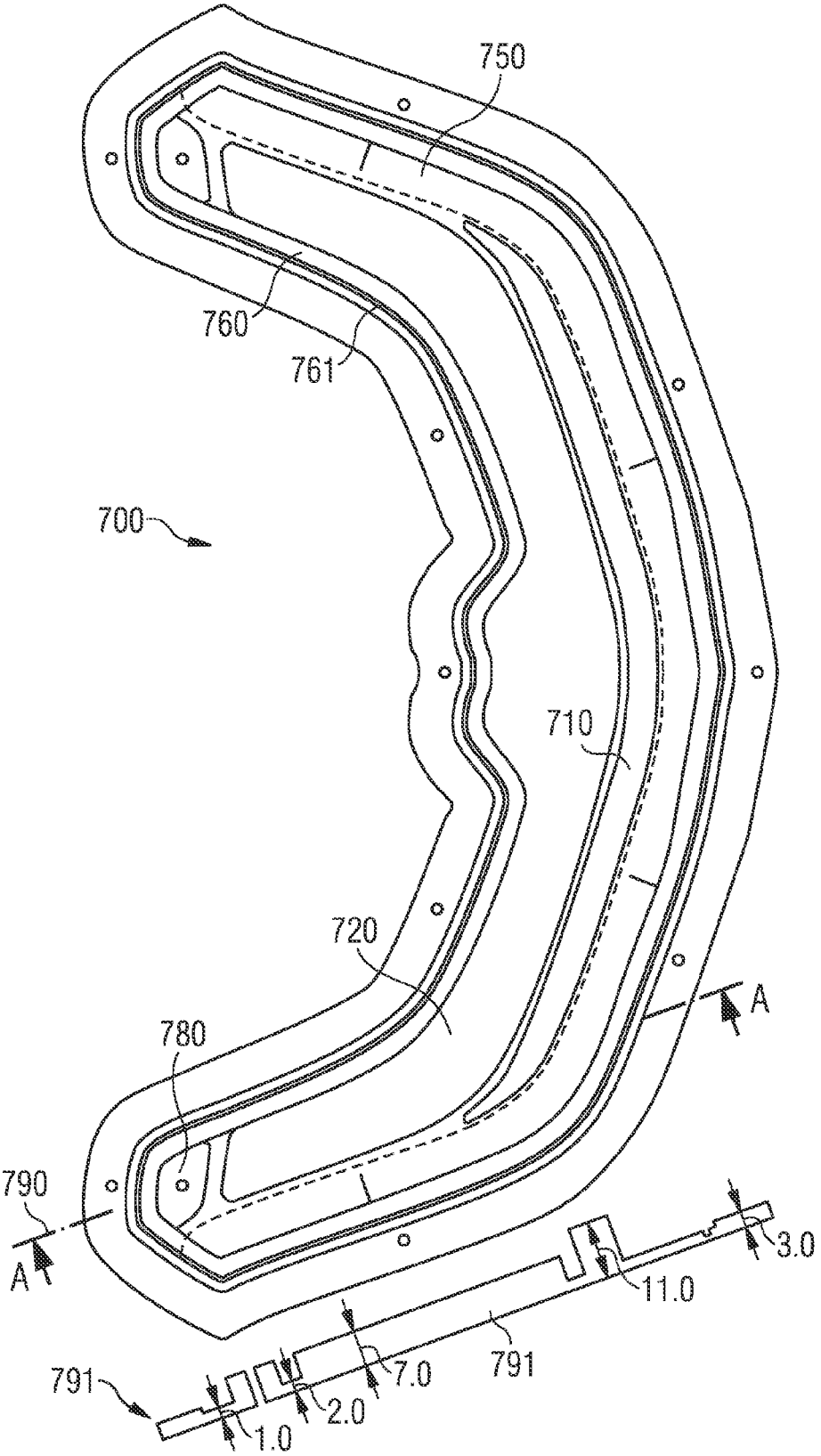
FIG. 7 is a top view of a collar member for providing a heel portion for a shoe, according to certain embodiments of the present invention.

In FIG. 7, also an exemplary thickness profile 791 of the collar member 700 along the cross section 790 is provided. According to the thickness profile 791, the second collar portion comprises a thickness of approximately 7 mm. The first collar portion comprises a thickness of approximately 11 mm. In other words, the thickness of the first collar portion is increased by approximately 50% with respect to the second collar portion. In other embodiments, the thickness increase may amount to approximately 100%, or more. In some embodiments, the thickness of the first and/or second collar portion may locally vary due to recesses described earlier. In such cases the thickness of a collar portion refers to a region without such a recess. The lace portion 780 comprises a thickness of 7 mm. In other embodiments, it may comprise a thickness essentially similar to the thickness of the second collar portion 710.

The first and second collar portions 710 and 720 and the lace portion 780 may be formed by respective foam layers in between the inner layer and the outer layer of the collar, for example as explained with respect to FIGS. 5 and 6. The first and second collar portions 710 and 720 may be separated from each other by a region essentially not comprising foam, being formed solely by the inner layer and the outer layer of the collar. Such a region may comprise a thickness of approximately 0.5-2 mm. The region may comprise only a minimum width separating the first and second collar portions 710 and 720, such as 0.5-2 mm. Alternatively, a separating region may comprise foam which is compressed to a thickness of 0.5-2 mm by hot-pressing. For example, by hot-pressing, the pieces of foam that will form the first collar portion and the second collar portion may by uncompressed or only slightly compressed in the first and second collar portions, whereas they are compressed more strongly in a separating region. The latter is the case in the collar portion 700. A separating region may improve the adaptation of the collar to the foot/ankle/leg of a wearer. In other embodiments, no such separating region may be provided. The first and second collar portions may then be distinguished by their different thicknesses.

Similarly, the third collar portion 760 and the attachment portion 750 comprise a thickness of approximately 0.5-2 mm. Also these portions, in the embodiments of collar portion 700, do not comprise any foam and may e. g. solely be formed by the inner layer and the outer layer of the collar portion. In other embodiments, the third collar portion 760 and/or the portion 750 may also comprise a foam layer. The inner layer and the outer layer of the collar may be provided with different materials and/or textures. Moreover, different regions of the inner and outer layer may be provided with different colors or additional elements, as required. The features explained above with reference to FIG. 7 may be similarly implemented in other embodiments described herein.

Figure 8A:
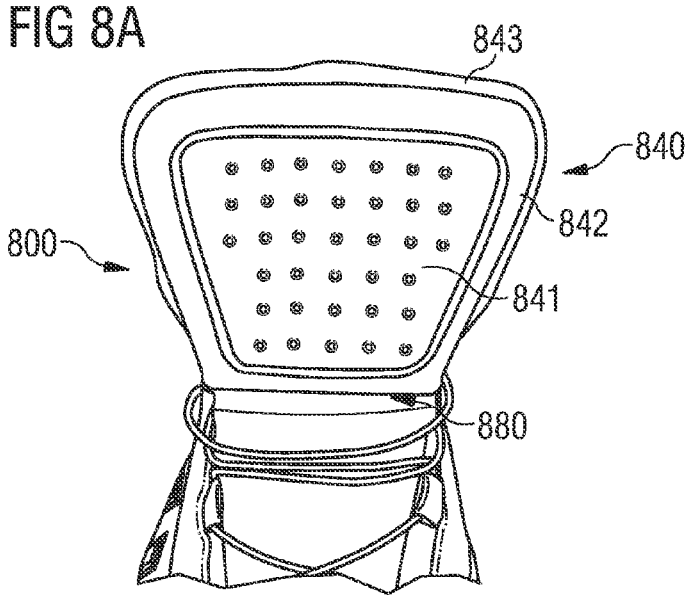
FIG. 8A is a view of a tongue, according to certain embodiments of the present invention.

Further embodiments for a shoe will now be described with reference to FIGS. 8A, 8B and 8C. FIG. 8A shows a shoe 800 which comprises a tongue 840. The tongue 840 comprises a first tongue portion 841, a second tongue portion 842 and a third tongue portion 843. The flexibility of the third tongue portion 843 is greater than the flexibility of the second tongue portion 842 which, in turn, is greater than the flexibility of the first tongue portion 841. The second tongue portion 842 is arranged above the first tongue portion 841, and the third tongue portion 843 is arranged above the second tongue portion 842. In some embodiments, no third tongue portion 843 is provided.

The tongue 840 may comprise, similarly to the various collars described herein, an inner layer and an outer layer. Moreover, the first and second tongue portions 841 and 842 comprise foam layers. The foam layer comprised by the first tongue portion 841 is thicker than the foam layer comprised by the second tongue portion. The third tongue portion, in the embodiments according to shoe 800, does not comprise any foam. In other embodiments, other foam layer arrangements may be used for the various tongue portions. The tongue may be connected to the shoe by a seam 880.

Figure 8B:
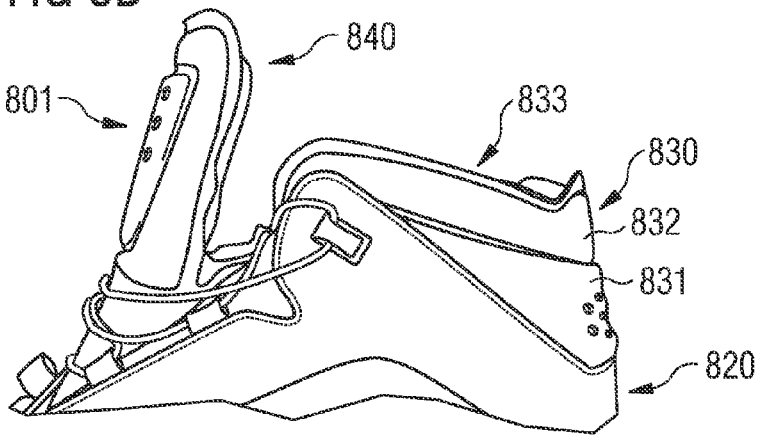
FIGS. 8B-C are side views of a hiking shoe with the tongue of FIG. 8A.
Figure 8C:
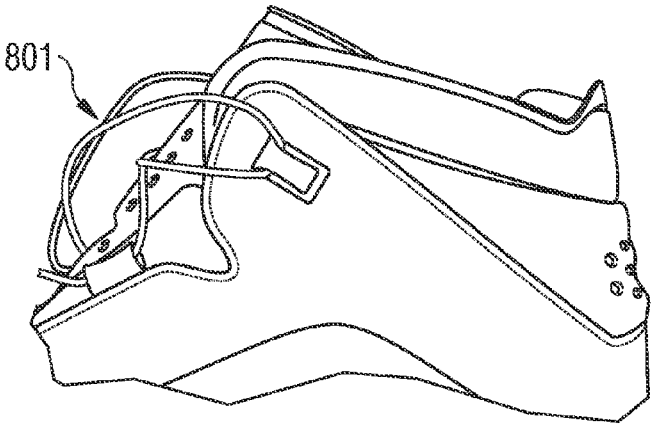

FIG. 8B shows further embodiments of a shoe 801 with a tongue 840, as described with reference to FIG. 8A, and a rigid heel portion 820 as well as a collar 830 which are substantially similar to the rigid heel portion 220 and the collar 230 described with reference to FIGS. 2A, 2B and 2C. The thicknesses and dimensions of the first, second and third tongue portions 841, 842 and 843 may be adapted to the thicknesses and dimensions of the first, second and third collar portions 831, 832 and 833 of the collar 830. The tongue 840 and the collar 830 may thus provide a fully circumferential, three-step sealing of the gap between the shoe and the wearer's ankle when closing the shoe 801 as depicted in FIG. 8C. The thickness of the second tongue portion 842 may be reduced compared to the thickness of the second collar portion 832.

In the following, further embodiments which may be used particularly for sports or other application different than hiking will be described with reference to FIGS. 9-12. These embodiments do not necessarily comprise a collar with a first collar portion and a second collar portion, wherein the first and second collar portions are configured to partially engage an ankle of a wearer on the lateral side, medial side and rear side of the ankle when worn and wherein the second collar portion is more flexible than the first collar portion.

Embodiments for a shoe 900 will be explained in the following with reference to FIGS. 9A-C. The shoe 900 comprises a sole 910 and a rigid heel portion 920. A collar 930 that is more flexible than the rigid heel portion 920 is arranged above the rigid heel portion 920 and partially engages the ankle of the wearer on the lateral, rear and medial sides.

Figure 9A:
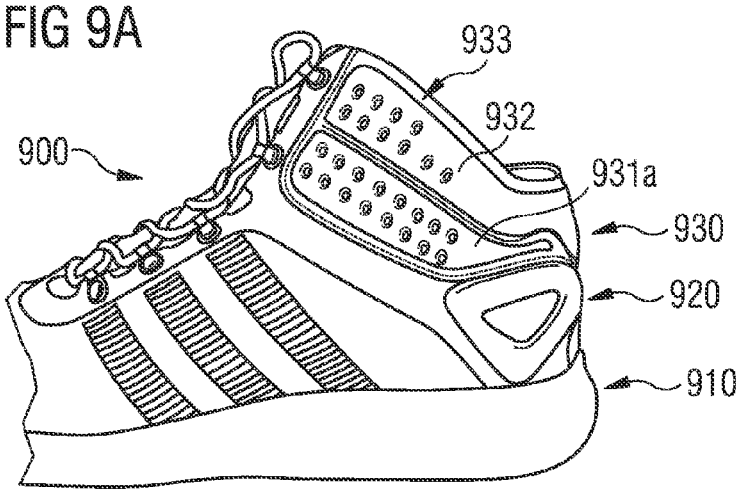
FIGS. 9A-C are side and rear views of a shoe with a flexible collar, according to certain embodiments of the present invention.
Figure 9B:
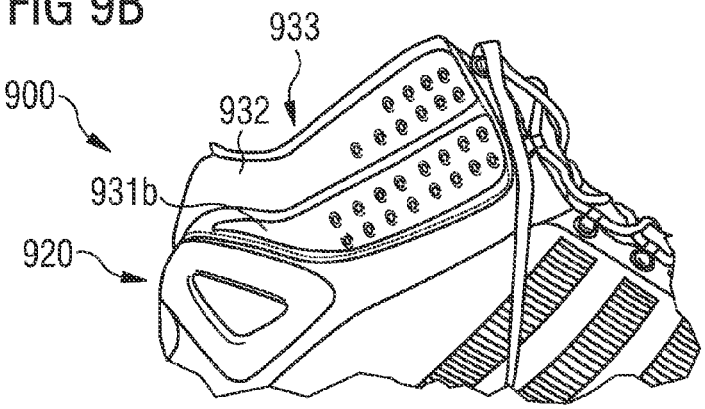
Figure 9C:
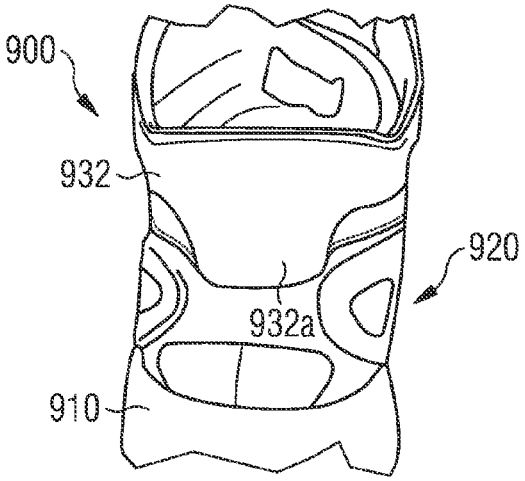

The collar 930 comprises collar portions 931*a* and 931*b*, see lateral and medial views of FIGS. 9A and 9B, respectively. The portions 931*a* and 932*b* partially engage the ankle on the lateral and medial sides, respectively. Moreover, the collar 930 comprises a second collar portion 932 and a third collar portion 933, each partially engaging the ankle on the lateral, medial and rear sides of the ankle. The third collar portion 933 is arranged above the second collar portion 932, and the second collar portion 932 is essentially arranged above the portions 931*a* and 932*b*.

Similarly as described with respect to the previous embodiments, the collar 930 comprises an inner layer and an outer layer and may be fabricated by hot-pressing without a seam. The third collar portion 933 is substantially similar to the third collar portions described earlier with reference to other embodiments. Similarly, the second collar portion 932 and the collar portions 931*a* and 931*b* may comprise foam layers as previously described with reference to other embodiments. The second collar portion 932 and the collar portions 931*a* and 931*b* may also include recesses, as described earlier. In certain embodiments, these recesses, in the shoe 900, are however, provided at the medial and lateral sides in all three of these portions. The thusly strengthened medial and lateral sides of the collar may thus be provided with a greater height without losing their dimensional stability. Hence, the collar may provide an improved sealing. The height is not increased in the heel region, to provide a better feel in this sensitive area. The second collar portion 932, in the heel region, provides an extension 932*a*, which extends further downward than the remainder of the second collar portion 932. This may contribute to softening the heel portion and further increase the wearing comfort for applications which require a less rigid fixation of the foot in the heel region.

In the shoe 900, the second collar portion 932 and the collar portions 931*a* and 931*b* may comprise a similar thickness and flexibility. However, the third collar portion 933 comprises a reduced thickness and an increased flexibility to ensure a particularly improved sealing.

Similar aspect ratios, i.e. ratios between a greatest thickness of the collar and its average or greatest height, may be used with the shoe 900 as described before. However, the collar 930 may comprise its greatest height on the lateral and medial sides.

Figure 10A:
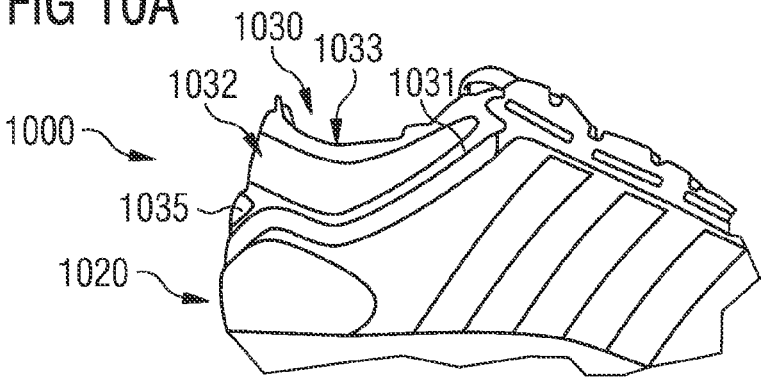
FIGS. 10A-C are side and rear views of a shoe with a flexible collar, according to certain embodiments of the present invention.
Figure 10B:
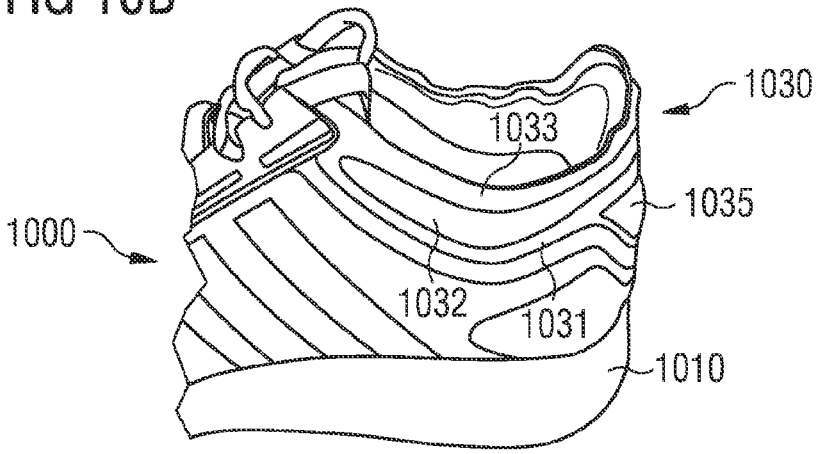
Figure 10C:
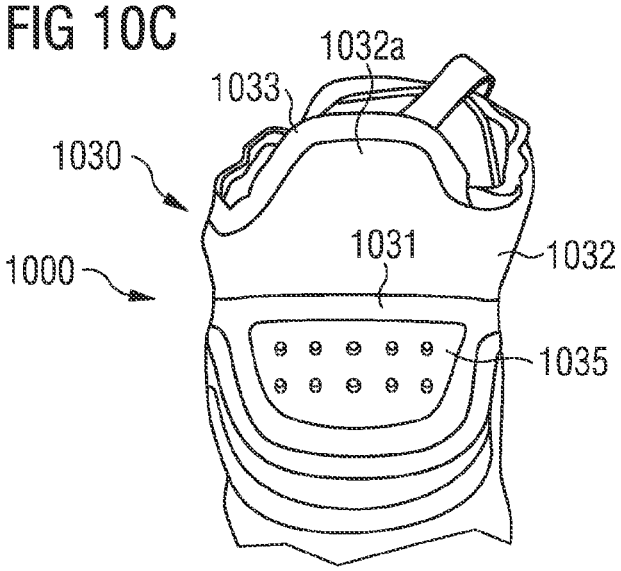

Further embodiments for a shoe 1000 will now be described with reference to FIGS. 10A-C. Shoe 1000 comprises a sole 1010 and a rigid heel portion 1020. Moreover, shoe 1000 comprises a collar 1030 that is more flexible than and arranged above the rigid heel portion 1020. The collar 1030 partially engages the ankle of the wearer on the lateral, rear and medial sides. The collar 1030 is fabricated, e.g. by hot-pressing, without a seam, and may comprise an inner layer and an outer layer and foam layers as previously described.

The collar 1030 comprises a first collar portion 1031 and a third collar portion 1033 which are relatively flexible. In some embodiments, the first collar portion 1031 comprises a foam layer which is strongly compressed. The third collar portion 1033 optionally also comprises a strongly compressed foam layer. The second collar portion 1032, which is arranged above the first collar portion 1031 and below the third collar portion 1033, comprises a foam layer which is essentially uncompressed. The second collar portion 1032 is less flexible than the first and third collar portions 1031 and 1033. The foam layer of the second collar portion 1032 may be thicker than those of the first and, if applicable, third collar portions. It optionally comprises an extension 1032*a* in the heel region, which is slightly elevated relative to the remainder of the second collar portion 1032. This extension may facilitate putting on the shoe. Each of the first, second and third collar portions partially engage the ankle on the lateral, rear and medial sides.

A heel collar portion 1035 may be arranged below the first collar portion. This heel collar portion 1035 may comprise a foam layer and may be less flexible than the second collar portion 1032. The heel collar portion 1035 may optionally comprise a plurality of recesses which contribute to making the portion less flexible. Thus, the wearing comfort in the heel region may be improved and at the same time a required minimum degree of stability may be provided.

While similar aspect ratios may be used with the shoe 1000 as described before, slightly larger aspect ratios, i.e. collars with relatively smaller heights may be desirable in certain embodiments. The shoe 1000 may be particularly useful for applications which require low-cut shoes.

Figure 11A:
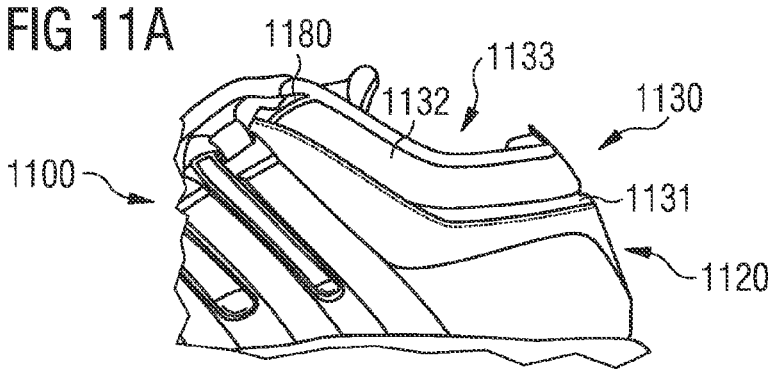
FIGS. 11A-C are side and rear views of a shoe with a flexible collar, according to certain embodiments of the present invention.
Figure 11B:
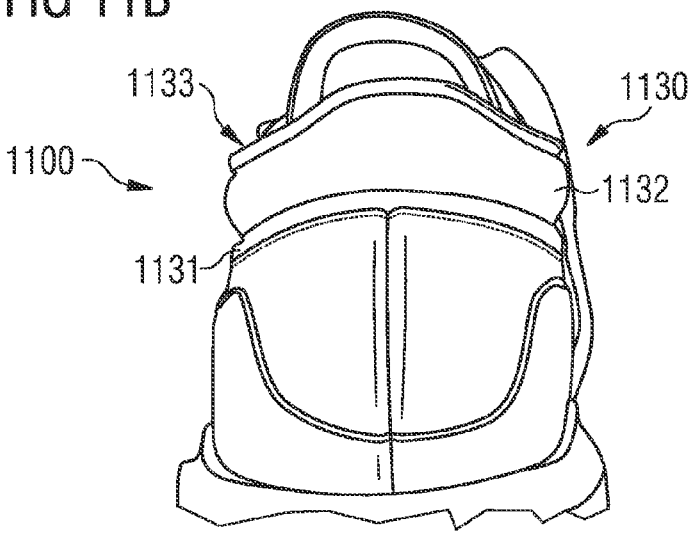
Figure 11C:
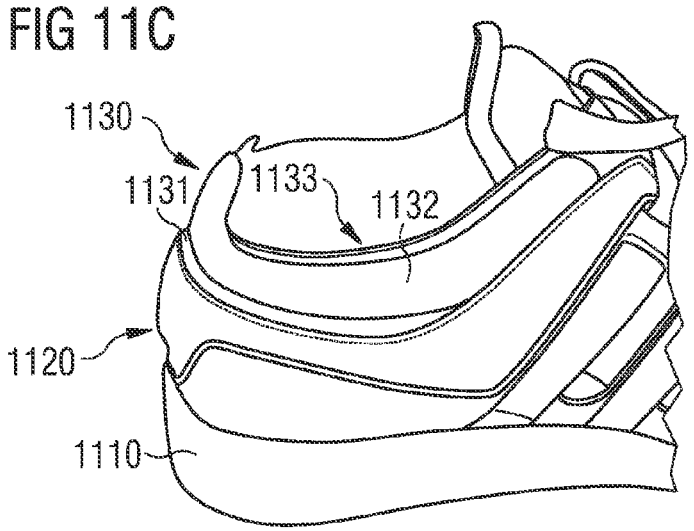

With reference to FIGS. 11A-C, further embodiments for a shoe 1100 will be explained. Shoe 1100 comprises a sole 1110, a rigid heel portion 1120, and a collar 1130 arranged above the rigid heel portion 1120 which is more flexible than the rigid heel portion 1120. Similarly as collar 1030, collar 1130 comprises a first collar portion 1131, a second collar portion 1132 arranged above the first collar portion 1131, and a third collar portion 1133 arranged above the second collar portion.

The third and second collar portions 1133 and 1132 of collar 1130 are substantially similar to those of collar 1030. Both portions partially engage the ankle on the lateral, rear and medial sides. The first collar portion 1131 comprises a foam layer, which may optionally be compressed compared to the foam layer of the second collar portion 1132. The first collar portion 1131 partially engages the rear side of the ankle and the medial and lateral sides of the ankle. Collar 1130 does not comprise a heel collar portion, although this option is a possibility in certain embodiments. The collar 1130 also comprises a lace portion 1180, at which shoe laces may be fixed. The various collar portions of collars 930, 1030, 1130 may be stretchable. They may also be combined with further features described herein.

Figure 12A:
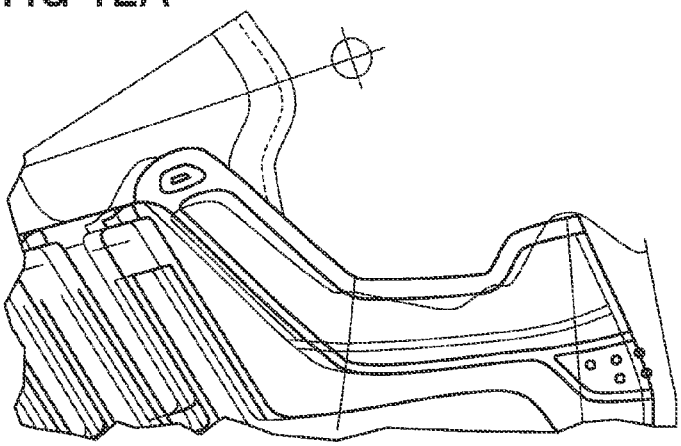
FIG. 12A is a side view of a flexible collar, according to certain embodiments of the present invention.
Figure 12B:
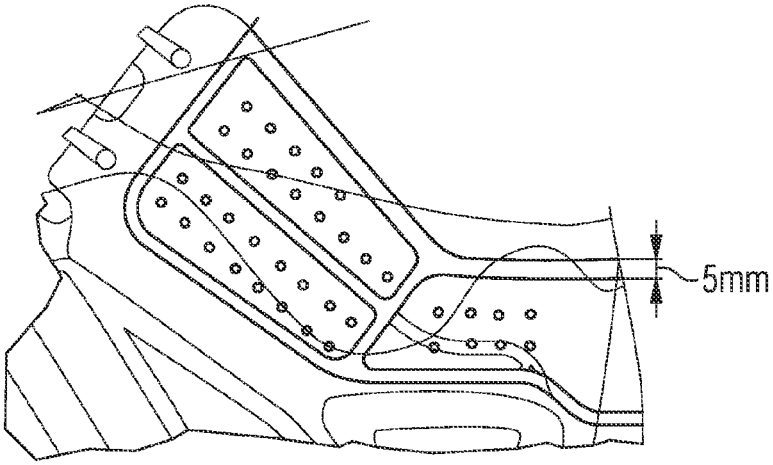
FIG. 12B is a side view of a flexible collar, according to certain embodiments of the present invention.
Figure 12C:
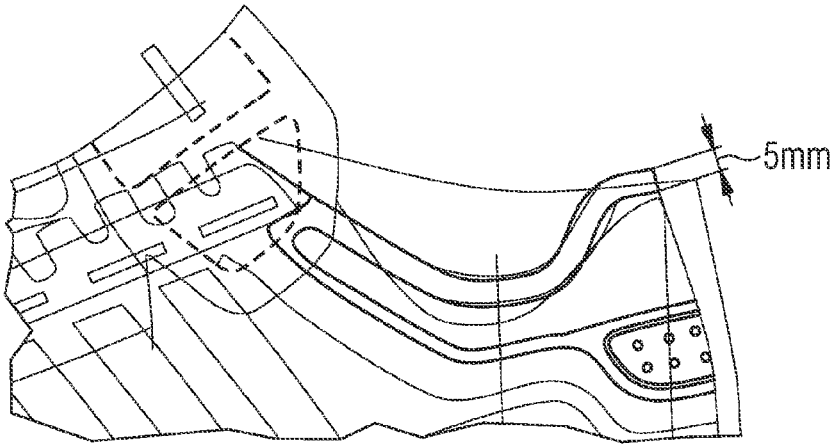
FIG. 12C is a side view of a flexible collar, according to certain embodiments of the present invention.

The further FIGS. 12A-C show further embodiments for designs of collars, which are arranged above a rigid heel portion of a shoe, wherein the collar is more flexible than the rigid heel portion. The various collars of these figures partially engage an ankle of a wearer of the shoe at least on the rear side, the lateral side and the medial side of the ankle. They each comprise an inner layer and an outer layer connected by hot-pressing, wherein the collar does not comprise any seam. In each of the embodiments of FIGS. 12A-C, various portions of the respective collar are discerned by the solid lines in these figures. These collar portions may be similar to the respective portions of the collar portions explained with reference to FIGS. 9A-C, 10A-C, 11A-C.

In the following, further examples are described to facilitate the understanding of the invention:

1. Shoe (100; 200; 300; 801), particularly hiking shoe, comprising
   a. a rigid heel portion (120; 220; 320; 820);
   b. a collar (130; 230; 330; 830) arranged above the rigid heel portion (120; 220; 320; 820), the collar (130; 230; 330; 830) comprising a first collar portion (131; 231; 331; 831) and a second collar portion (132; 232; 332; 832);
   c. the first collar portion (131; 231; 331; 831) and the second collar portion (132; 232; 332; 832) encompassing a foot of a wearer of the shoe on the lateral side, the medial side and the rear side of the foot;
   d. wherein the first collar portion (131; 231; 331; 831) is more flexible than the rigid heel portion (120; 220; 320; 820) and wherein the second collar portion (132; 232; 332; 832) is more flexible than the first collar portion (131; 231; 331; 831).

2. Shoe (100; 200; 300; 801) according to example 1, wherein the second collar portion (132; 232; 332; 832) is stretchable and adapted to sealingly encompass the foot on the medial side, the lateral side and the rear side of the foot.
3. Shoe (100; 200; 300; 801) according to examples 1 or 2, wherein a thickness of the first collar portion (131; 231; 331; 831) is increased by at least 50% or at least 100% compared to a thickness of the second collar portion (132; 232; 332; 832).
4. Shoe (100; 200; 300; 800) according to one of the preceding examples, wherein the collar (130; 230; 330; 830) comprises an inner layer and an outer layer.
5. Shoe (100; 200; 300; 801) according to example 4, wherein the inner layer and the outer layer are connected via hot-pressing.
6. Shoe (100; 200; 300; 801) according to one of examples 4 or 5, wherein the collar does not comprise any seam.
7. Shoe (100; 200; 300; 801) according to one of examples 4-6, wherein the outer layer comprises a rip stop fabric.
8. Shoe (100; 200; 300; 801) according to one of examples 4-7, wherein the inner layer comprises a lining.
9. Shoe (100; 200; 300; 801) according to one of examples 4-8, wherein the first collar portion (131; 231; 331; 831) and the second collar portion (132; 232; 332; 832) each comprise a foam layer between the inner and the outer layer.
10. Shoe (100; 200; 300; 801) according to one of the preceding examples, wherein an opening provided by the second collar portion (132; 232; 332; 832) is smaller than an opening provided by the first collar portion (131; 231; 331; 831).
11. Shoe (100; 801) according to one of the preceding examples, wherein the shoe further comprises a tongue (140; 840), the tongue (140; 840) comprising a first tongue portion (141; 841) and a second tongue portion (142; 842), wherein the second tongue portion (142; 842) is more flexible than the first tongue portion (141; 841).
12. Shoe (100; 801) according to example 11, wherein the second collar portion (132; 832) and the second tongue portion (142; 842) are adapted to sealingly encompass the foot on the medial side, the lateral side, the rear side and the front side of the foot.
13. Shoe (100; 801) according to one of examples 11 or 12, wherein a thickness of the first tongue portion (141; 841) is increased by at least 50% or at least 100% compared to a thickness of the second tongue portion (142; 842).
14. Shoe (100; 801) according to one of examples 11-13, wherein a thickness of the second tongue portion (142; 842) is reduced compared to a thickness of the second collar portion (132; 832).

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A shoe comprising a rigid heel portion; and a collar arranged above the rigid heel portion, the collar comprising an inner layer, an outer layer, a first collar portion, and a second collar portion;

the first collar portion and the second collar portion configured to partially engage an ankle of a wearer of the shoe on a lateral side, a medial side, and a rear side of the ankle when worn;

the first collar portion comprising a first part of the inner layer and a first part of the outer layer, the first parts of the inner and outer layers being arranged above the rigid heel portion;

the second collar portion comprising a second part of the inner layer and a second part of the outer layer, the second parts of the inner and outer layers being arranged above the first parts of the inner and outer layers;

wherein the first collar portion is more flexible than the rigid heel portion and wherein the second collar portion is more flexible than the first collar portion.

2. The shoe according to claim 1, wherein the second collar portion is stretchable and adapted to sealingly partially engage the ankle on the medial side, the lateral side and the rear side of the ankle.

3. The shoe according to claim 1, wherein a thickness of the first collar portion is at least 50% greater than a thickness of the second collar portion.

4. The shoe according to claim 1, wherein the inner layer and the outer layer are connected via hot-pressing.

5. The shoe according to claim 1, wherein the collar does not comprise any seam on the inner layer along a transition between the first collar portion and the second collar portion and does not comprise any seam on the outer layer along the transition between the first collar portion and the second collar portion.

6. The shoe according to claim 1, wherein the outer layer comprises a rip stop fabric.

7. The shoe according to claim 1, wherein the inner layer comprises a lining for an interior of the shoe.

8. The shoe according to claim 1, wherein the first collar portion and the second collar portion each comprise a foam layer between the inner and the outer layer.

9. The shoe according to one claim 1, wherein an opening provided by the second collar portion is smaller than an opening provided by the first collar portion.

10. The shoe according to claim 1, wherein the shoe further comprises a tongue, the tongue comprising a first tongue portion and a second tongue portion, wherein the second tongue portion is more flexible than the first tongue portion.

11. The shoe according to claim 10, wherein the second collar portion and the second tongue portion are adapted to sealingly engage the ankle on the medial side, the lateral side, the rear side and the front side of the ankle.

12. The shoe according to claim 10, wherein a thickness of the first tongue portion is at least 50% greater than a thickness of the second tongue portion.

13. The shoe according to claim 10, wherein a thickness of the second tongue portion is less than a thickness of the second collar portion.

14. The shoe according to claim 10, wherein a thickness of the first tongue portion is at least 100% greater than a thickness of the second tongue portion.

15. The shoe according to claim 1, wherein a thickness of the first collar portion is at least 100% greater than a thickness of the second collar portion.

* * * * *